US008630024B2

(12) United States Patent
Shiraishi

(10) Patent No.: US 8,630,024 B2
(45) Date of Patent: Jan. 14, 2014

(54) SHEET FEEDING APPARATUS

(75) Inventor: Mitsuo Shiraishi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 1123 days.

(21) Appl. No.: 12/561,968

(22) Filed: Sep. 17, 2009

(65) Prior Publication Data

US 2010/0066004 A1 Mar. 18, 2010

(30) Foreign Application Priority Data

Sep. 17, 2008 (JP) ..... 2008-237892

(51) Int. Cl.
*B65H 7/02* (2006.01)

(52) U.S. Cl.
USPC ..... 358/451; 358/505; 358/498; 358/296; 358/474; 271/10.03; 271/145; 271/10.01; 347/177

(58) Field of Classification Search
USPC ..... 358/451, 505, 498, 296, 474; 271/10.03, 145, 10.01; 347/177
See application file for complete search history.

(56) References Cited

U.S. PATENT DOCUMENTS

| | | | | |
|---|---|---|---|---|
| 4,464,786 | A * | 8/1984 | Nishito et al. | 382/135 |
| 2004/0094887 | A1 * | 5/2004 | Hidaka et al. | 271/10.01 |
| 2005/0076798 | A1 * | 4/2005 | Sato et al. | 101/116 |

FOREIGN PATENT DOCUMENTS

| | | | |
|---|---|---|---|
| JP | 62-111852 | A | 5/1987 |
| JP | 06-227704 | A | 8/1994 |
| JP | 09-301573 | | 11/1997 |
| JP | 10-104759 | A | 4/1998 |
| JP | 2003-205654 | A | 7/2003 |
| JP | 2007-161427 | A | 6/2007 |

* cited by examiner

*Primary Examiner* — Steven Kau
*Assistant Examiner* — Quang N Vo
(74) *Attorney, Agent, or Firm* — Canon USA Inc. IP Division

(57) ABSTRACT

A sheet feeding apparatus includes: a sheet loading unit configured to load a plurality of sheets; a sheet feeding unit configured to feed the sheets loaded on the sheet loading unit; a light emitting unit configured to irradiate a sheet loaded on the sheet loading unit; an image sensor disposed at a position opposing the sheet loaded on the sheet loading unit and configured to sense an image reflected with light irradiated by the light emitting unit; and a trailing edge detection unit configured to cause the image sensor to repetitively perform sensing during sheet conveyance by the sheet feeding unit, compare images sensed by the image sensor, and detect a trailing edge of the sheet currently being conveyed from the sheet feeding unit based on a determination of an area where a pattern remains unchanged.

17 Claims, 11 Drawing Sheets

SHEET FEEDING APPARATUS

BACKGROUND OF THE INVENTION

1. Field of the Invention

The present invention relates to a sheet feeding apparatus, such as an automatic document feeder, provided mainly on a copying machine and an image reading apparatus.

2. Description of the Related Art

The document feeder attached to conventional document reading apparatuses drives a motor to lower a pickup roller which is waiting ready at a standby position distant from the uppermost sheet loaded on a document positioning plate, in synchronization with a sheet feeding start signal. The pickup roller comes in contact with the uppermost sheet on the document positioning plate and then is rotatively driven to feed the uppermost sheet. When the leading edge of the uppermost sheet reaches a sheet detection sensor disposed on the downstream side in the sheet conveyance direction, the document feeder drives a motor to raise the pickup roller to the standby position to be ready to feed the following sheet.

When the uppermost sheet is conveyed by a conveyance roller disposed on the downstream side and then the document feeder detects that the trailing edge of the sheet has passed the sheet detection sensor, the document feeder starts feeding the second sheet. More particularly, after being lowered, the pickup roller rotates to feed the second sheet. The document feeder repeats a similar operation to feed the third and subsequent sheets.

With respect to the copying machine, an automatic zooming function is known. This function compares the sheet size to be read by the document reading apparatus with the size of a recording sheet set in a printer unit, and enlarges or reduces the size of the read image to fit it into the size of the recording sheet for image formation. To perform this function, it is necessary to set the magnification ratio at the zooming processing unit before reading a document image. To set the magnification ratio, it is necessary that the sheet size is known before reading the document image.

To detect the sheet length, in a conventional method, the sheet length is calculated based on timing at which the sheet detection sensor disposed on the downstream side in the sheet conveyance direction detects the leading and trailing edges of the sheet, and the conveyance speed.

This method, however, determines how far the leading edge of the sheet has been fed toward the downstream side of the trailing edge when the sheet detection sensor detects the trailing edge of the sheet. Therefore, the conveyance path length required by the method is such that the leading edge of the sheet has not reached the reading position when the sheet detection sensor detects the trailing edge of the sheet. As a result, there has been a problem that the document feeder cannot be downsized.

Particularly in a case of a compact copying machine, it is also necessary to downsize the document feeder mounted on the document reading apparatus. However, since reducing the conveyance path length of the sheet conveyance apparatus makes it impossible to detect the sheet length before the leading edge of the sheet reaches the reading position, there arises a problem that the automatic zooming function cannot be implemented.

If the image reading apparatus starts image reading before the sheet size is determined, the magnification ratio is not determined and therefore it is necessary to once store the read image in memory. In this case, since the sheet size has not been determined, the document feeder constantly requires image memory which fits the maximum conveyable sheet size, resulting in cost increase.

Further, since the sheet size is not determined until the trailing edge passes the sheet detection sensor disposed on the downstream side of a sheet separation position, the timing of sheet size detection is delayed, preventing the increase in operating speed of the apparatus.

A method discussed in Japanese Patent Application Laid-Open No. 09-301573 provides a roller rotating in response to the movement of the uppermost sheet on a document tray of the document feeder, a disc coaxially rotating with the roller, and a photointerrupter which detects holes on the disc. While the uppermost sheet is moving, the roller is rotating and a signal is output from the photointerrupter. When the trailing edge of the sheet has passed the roller, the roller stops rotating and the signal is no longer output from the photointerrupter. When the signal is not output from photointerrupter, the document feeder detects the trailing edge of the sheet. Then, after a fixed time has elapsed since the document feeder detected the trailing edge of the sheet, it starts lowering the pickup roller. In this way, the trailing edge of the sheet can be detected at earlier timing than the conventional method for detecting the trailing edge by use of the sheet detection sensor disposed on the downstream side after sheet separation.

However, the method discussed in Japanese Patent Application Laid-Open No. 09-301573 cannot strictly determine whether or not the trailing edge of the sheet has passed the sheet detection sensor because the roller rotating in response to the movement of the sheet may rotate because of the inertia of the body of revolution even after the trailing edge has passed the sheet detection sensor. Further, depending on the pitch of the holes (light-blocking portions and non-light-blocking portions of the photointerrupter) on the rotating disc, the trailing edge of the sheet is detected after a certain amount of time has elapsed since the trailing edge of the sheet actually passes the sheet detection sensor. Therefore, even if the photointerrupter stops immediately after the trailing edge has passed the sheet detection sensor, the actual trailing edge cannot be strictly detected.

Further, the method discussed in Japanese Patent Application Laid-Open No. 09-301573 determines timing of feeding the following sheet based on the detection of the trailing edge of the sheet. Therefore, there has been no problem of sheet feed timing generation even if the trailing edge cannot be strictly detected.

However, to perform the automatic zooming function, it is necessary to accurately detect the sheet size and therefore detect the trailing edge with high accuracy. For this reason, the method discussed in Japanese Patent Application Laid-Open No. 09-301573 cannot be used as it is.

SUMMARY OF THE INVENTION

The present invention is directed to a sheet feeding apparatus which solves the above-mentioned subjects.

The present invention is also directed to a sheet feeding apparatus that can detect the trailing edge of the sheet with high accuracy at early timing after sheet separation.

Further, the present invention is directed to a sheet feeding apparatus that can quickly detect the trailing edge of the sheet without increasing the size of the apparatus.

According to an aspect of the present invention, a sheet feeding apparatus includes: a sheet loading unit configured to load a plurality of sheets; a sheet feeding unit configured to feed the sheets loaded on the sheet loading unit; a light emitting unit configured to irradiate a sheet loaded on the sheet loading unit; an image sensor disposed at a position opposing the sheet loaded on the sheet loading unit and configured to sense an image reflected with light irradiated by the light emitting unit; and a trailing edge detection unit configured to cause the image sensor to repetitively perform sensing during sheet conveyance by the sheet feeding unit, compare the images sensed by the image sensor, and detect a trailing edge of the sheet currently being conveyed from the sheet feeding unit based on a determination of an area where a pattern remains unchanged in the compared images.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
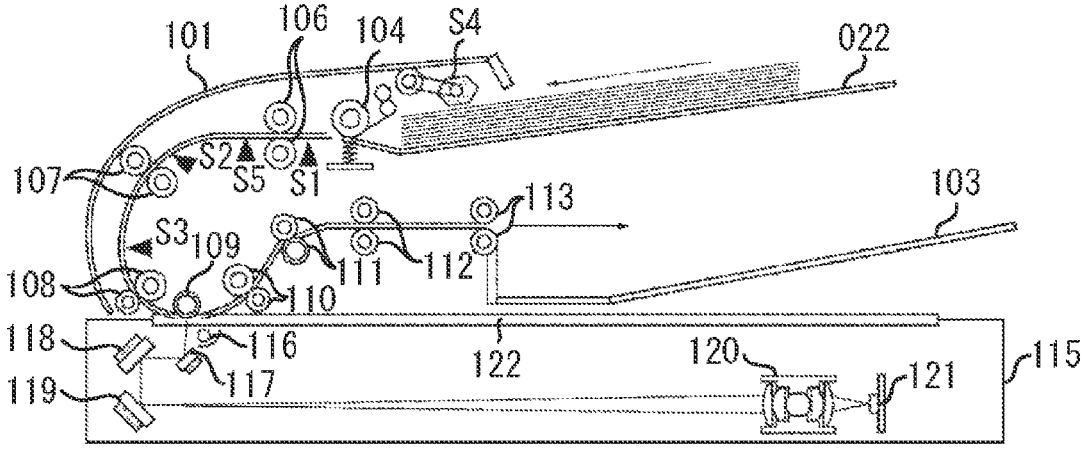
FIG. 1 is a sectional view of a document feeder according to an exemplary embodiment of the present invention.

FIG. 1 is a schematic sectional view of a document feeder as a sheet feeding apparatus and a document reading apparatus according to the present exemplary embodiment.

A document feeder 101 will be described below. A document tray 102 is loaded with a plurality of document sheets. A feeding roller 104 separates and feeds the uppermost sheet of the plurality of sheets loaded on the document tray 102. Each of conveyance roller pairs 106, 107, and 108 conveys the separated sheet. A conveyance roller 109 conveys the sheet at the document reading position. Each of conveyance roller pairs 110, 111, and 112 conveys the sheet after reading. The sheet subjected to image reading is discharged into a sheet discharge tray 103. A sheet detection sensor S1 is disposed between a feeding roller 104 and a conveyance roller pair 106 to detect whether or not a sheet is present. A sheet detection sensor S2 is disposed on the upstream side of the conveyance roller pair 107. A sheet detection sensor S3 is disposed between the conveyance roller pairs 107 and 108. Each of the sheet detection sensors S1 to S3, including a photo sensor to detect the leading and trailing edges of the sheet, is used to determine timing of light emission by a light source 116 and timing of image reading by a photoelectric conversion element 121. A trailing edge detection sensor S4 is disposed at a position opposing the sheet on the document tray 102 to determine the moving state of the uppermost sheet, thus detecting the trailing edge of the sheet. A sheet width detection sensor S5 detects the sheet width. The trailing edge detection sensor S4 is disposed on the upstream side of the feeding roller 104 in the sheet feeding direction. The trailing edge detection sensor S4 and the sheet width detection sensor S5 will be described in detail below.

A document reading apparatus 115 will be described below. When the light source 116 exposes a sheet, the light reflected by the sheet is imaged on the linear-shaped photoelectric conversion element 121 through folding mirrors 117, 118, and 119, and a lens 120. Although the present exemplary embodiment uses a charge-coupled device (CCD) as the photoelectric conversion element 121, a complementary metal-oxide semiconductor (CMOS) device may also be used. While the sheet is being conveyed on a document positioning glass plate 122, a document image is read at a position opposing the conveyance roller 109.

Document feeding and reading operations will be described below. The feeding roller 104 separates the sheets one by one from the plurality of sheets loaded on the document tray 102. The conveyance roller pairs 106, 107, and 108 convey the separated sheet to the conveyance roller 109 at the document reading position. When the sheet is irradiated with the light from the light source 116 that has moved to a position opposing the conveyance roller 109, the light reflected by the sheet reflects off the folding mirrors 117, 118, and 119 in this order, passes through an imaging lens 120, and then reaches the photoelectric conversion element 121.

The sheet subjected to image reading at the position opposing the conveyance roller 109 is conveyed by the conveyance roller pairs 110, 111, 112, and 113, and then discharged to a sheet discharge tray 103.

In addition to the document feeding-reading mode in which a document image is read while a sheet is being conveyed by the conveyance roller 109, the document reading apparatus 115 is provided with the document fixed-reading mode in which a document image is read from a sheet placed on the document positioning glass plate 122 while the light source 116 and the folding mirrors 117 to 119 are being moved.

Figure 2:
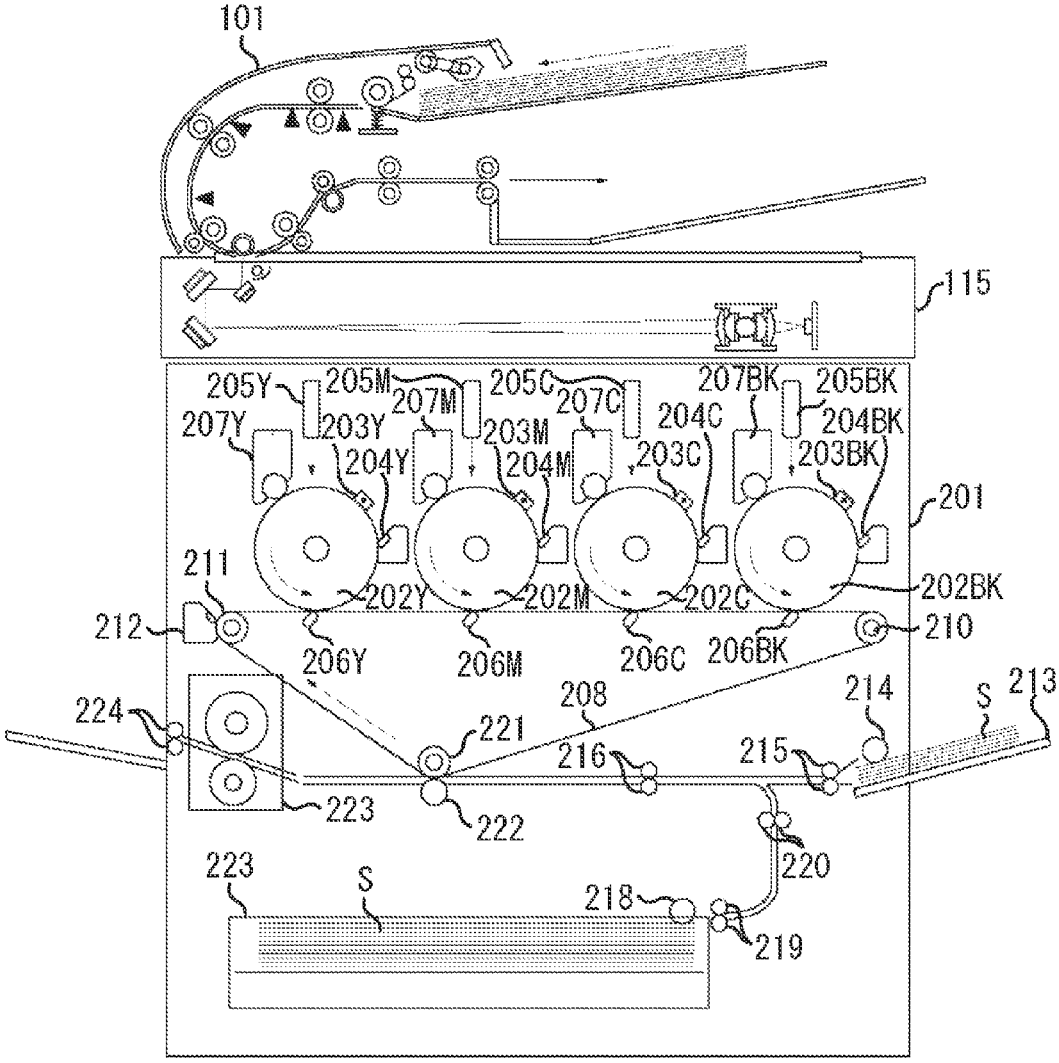
FIG. 2 is a sectional view of a color copying machine according to an exemplary embodiment of the present invention.

FIG. 2 is a schematic sectional view of an image forming apparatus 201. The image forming apparatus 201 includes the document feeder 101 and the document reading apparatus 115 mounted thereon. The image forming apparatus according to the present exemplary embodiment is an electrophotographic full-color printer.

The image forming apparatus 201 includes four different image forming stations, i.e., yellow, magenta, cyan, and black image forming stations which are respectively denoted by trailing letters Y, M, C, and BK of reference numerals. Each of the four image forming stations has a similar structure. Referring to FIG. 2, the image forming apparatus 201 includes photosensitive drums 202Y, 202M, 202C, and 202BK; charging devices 203Y, 203M, 203C, and 203BK; cleaners 204Y, 204M, 204C, and 204BK; laser scanning units 205Y, 205M, 205C, and 205BK; transfer blades 206Y, 206M, 206C, and 206BK; developing units 207Y, 207M, 207C, and 207BK; an intermediate transfer belt 208; rollers 210 and 211 for supporting the intermediate transfer belt 208; and a cleaner 212 for cleaning the intermediate transfer belt 208.

The image forming apparatus 201 further includes a manual feed tray 213 for loading recording sheets S; a pickup roller 214; a conveyance roller pair 215; a registration roller pair 216; a sheet cassette 217 for loading the recording sheets S, a pickup roller 218; a conveyance roller pair 219; a vertical path roller pair 220; a roller 221; a secondary transfer roller 222; a fixing unit 223; a discharge roller pair 224; and a sheet discharge tray 225.

The image forming apparatus 201 having the above-mentioned configuration forms electrostatic latent images on the photosensitive drums 202Y, 202M, 202C, and 202BK through respective laser scanning units 205Y, 205M, 205C, and 205BK having semiconductor laser as a light source. The developing units 207Y, 207M, 207C, and 207BK develop the electrostatic latent images produced on the photosensitive drums 202Y, 202M, 202C, and 202BK, respectively. Four color toner images developed on the photosensitive drums 202Y, 202M, 202C, and 202BK are transferred to the intermediate transfer belt 208 in overlapping manner. Then, the secondary transfer roller 222 collectively transfers the four color toner images to a recording sheet, and a heat fixing unit including a fixing roller pair and the discharge roller pair 224 fixes toner to form a permanent image.

In the meantime, a recording sheet is fed from the sheet cassette 217 or the manual feed tray 213, timed for registration by the registration roller pair 216, and then conveyed to the secondary transfer roller 222. An independent stepping motor drives each of the pickup rollers 214 and 218, the conveyance roller pairs 215 and 219, the vertical path roller pair 220, and the registration roller pair 216.

The size of the recording sheets S loaded on the manual feed tray 213 or the sheet cassette 217 is preset through an operation unit (not shown) by the user or predetected by a size detection sensor (not shown) provided in the sheet cassette 217.

Figure 3:
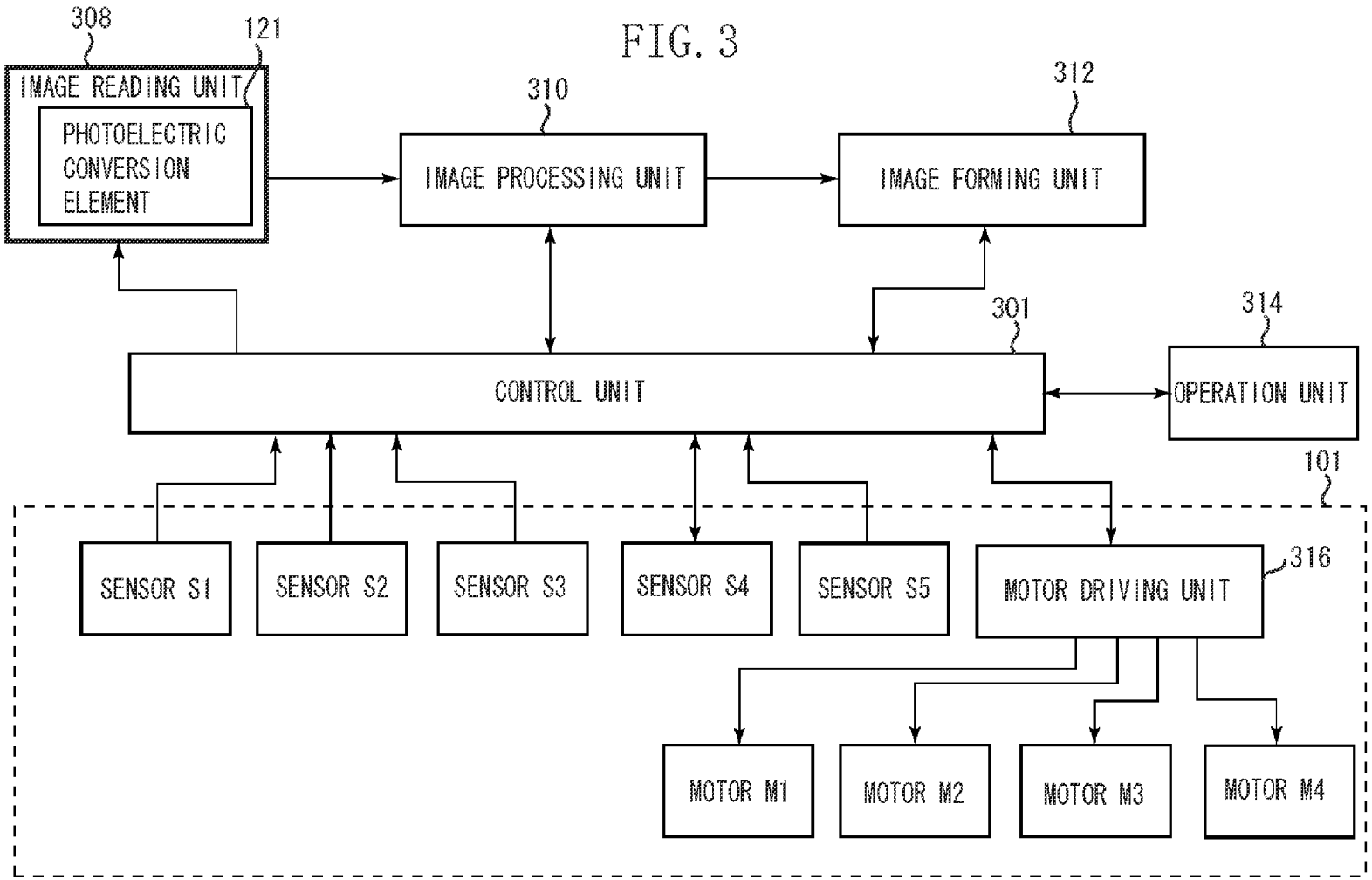
FIG. 3 is a block diagram illustrating the configuration of the color copying machine of FIG. 2.

FIG. 3 is a schematic block diagram illustrating the configuration of a color copying machine. A control unit 301 includes a central processing unit (CPU), a read-only memory (ROM), and a random access memory (RAM) to control the entire color copying machine. An image reading unit 308 includes the photoelectric conversion element 121, the light source 116, the folding mirrors 117 to 119 of FIG. 1, and motors for moving the light source 116 and the folding mirrors 117 to 119. An image processing unit 310 processes image signals output from the photoelectric conversion element 121, and outputs image signals for the four recording colors (yellow, magenta, cyan, and black). The image processing unit 310 also performs zooming processing. An image forming unit 312 includes the image forming stations shown in FIG. 2; a high-voltage generation unit which generates high voltages for charging, development, and transfer; a fixing driving unit which drives the fixing unit; and sensors and motors in the image reading apparatus and the image forming apparatus. An operation unit 314 includes operation keys and a display unit.

The apparatus enclosed by dotted lines of FIG. 3 denotes the document feeder. The above-mentioned sheet detection sensors S1 to S3, the trailing edge detection sensor S4, and the sheet width detection sensor S5 in the document feeder are connected to the control unit 301. A motor driving unit 316 has stepping motors M1, M2, M3, and M4 connected thereto, and supplies driving pulses to each motor. The motor M1 drives the feeding roller 104 and the conveyance roller pair 106. The motor M2 drives the conveyance roller pairs 107, 108, 110, and 111, and the conveyance roller 109. The motor M3 drives the conveyance roller pairs 112 and 113. The motor M4 can forwardly or reversely rotate to raise or lower the trailing edge detection sensor S4.

The automatic zooming function will be described below. As mentioned above, the size of the recording sheets S loaded on the manual feed tray 213 and the sheet cassette 217 of FIG. 2 is preset by a size detector (not shown) or the operation unit 314. The control unit 301 supplies the uppermost sheet of the document tray 102 through the document feeder 101. With the leading edge of the sheet in contact with the conveyance roller pair 106, the control unit 301 obtains the number of driving pulses of the drive motor M1 for the conveyance roller pair 106 for a time period since the conveyance roller pair 106 starts sheet conveyance until the trailing edge detection sensor S4 detects the trailing edge of the sheet. The control unit 301 obtains the length in the sheet conveyance direction based on the amount of sheet movement calculated from the obtained number of driving pulses, and the distance between the conveyance roller pair 106 and the trailing edge detection sensor S4; and determines the sheet size based on the sheet width detected by the sheet width detection sensor S5. It is also possible to obtain the amount of sheet movement based on the time period since the conveyance roller pair 106 starts sheet conveyance until the trailing edge detection sensor S4 detects the trailing edge of the sheet, and the conveyance speed. Then, the control unit 301 determines the magnification, with which the document image fits into the size of the recording sheets S, based on the size of the recording sheets S and the sheet size; and gives a relevant instruction to the image processing unit 310. Then, the photoelectric conversion element 121 reads the document image and transfers an image signal (RGB) to the image processing unit 310. The image processing unit 310 performs image zooming processing (enlargement or reduction) for the image signal based on the magnification ratio set by the control unit 301; and transfers the image signal subjected to image zooming processing (YMCK) to the image forming unit 312 for image formation on a recording sheet.

Figure 4:
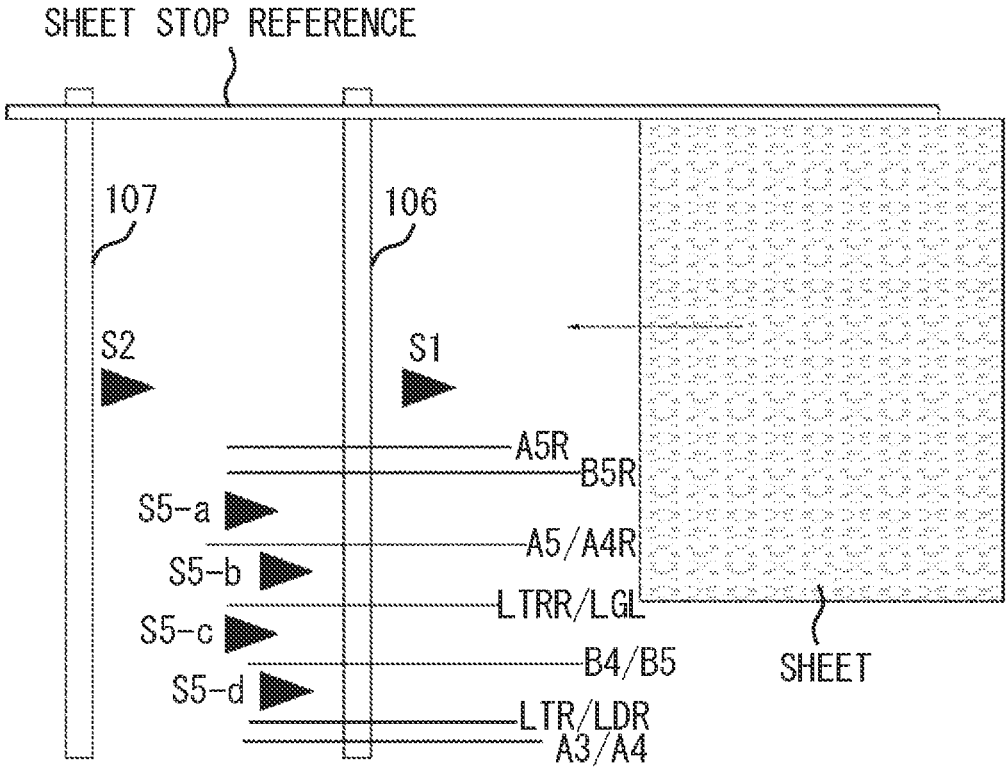
FIG. 4 illustrates a sheet width detection sensor.

The sheet width detection sensor S5 will be described below with reference to FIG. 4. The sheet width detection sensor S5 includes four sheet width detection sensors disposed at different distances from a sheet stop reference provided at an end of the sheet conveyance path so as to recognize different fixed sheet sizes. The conveyance roller pair 106 feeds the sheet separated by the feeding roller 104. When a predetermined time has elapsed after the document is detected by the sheet detection sensor S1, the control unit 301 detects the sheet width in the width direction perpendicularly intersecting the sheet conveyance direction based on outputs from four sheet width detection sensors (S5-*a*, S5-*b*, S5-*c*, and S5-*d*).

After the sheet detection sensor S1 detects the sheet, when none of the four sheet width detection sensors (S5-*a*, S5-*b*, S5-*c*, and S5-*d*) detects the sheet, the control unit 301 determines that the sheet width is the A5R or B5R size. Then, when the sheet width detection sensor S5-*a* detects the sheet and other three sheet width detection sensors (S5-*b*, S5-*c*, and S5-*d*) do not, the control unit 301 determines that the sheet width is the A5 or A4R size. Further, when the sheet width detection sensors S5-*a* and S5-*b* detect the document and the sheet width detection sensors S5-*c* and S5-*d* do not, the control unit 301 determines that the sheet width is the LETTER_R or LEGAL size. Further, when the sheet width detection sensor S5-*a*, S5-*b*, and S5-*c* detect the document and the sheet width detection sensor S5-*d* does not, the control unit 301 determines that the sheet width is B4 or B5 size. When all the four sheet width detection sensors (S5-*a*, S5-*b*, S5-*c*, and S5-*d*) detect the sheet, the control unit 301 determines that the sheet width is one of the A4, A3, and LETTER sizes.

Figure 5:
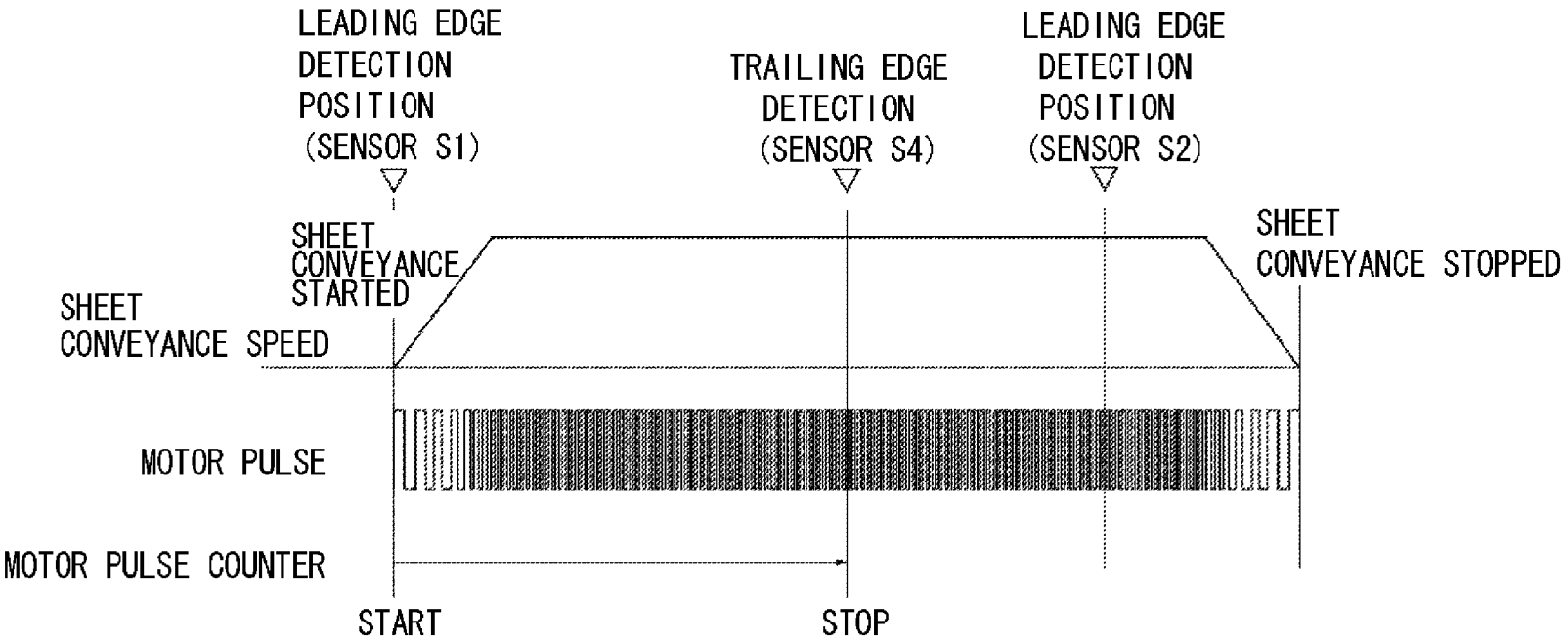
FIG. 5 is a timing chart of the calculation of the amount of sheet movement.

Then, procedures for detecting the sheet size will be described below. FIG. 5 is a timing chart illustrating a relation between the document feeding state and sensors (the sheet detection sensors S1 and S2 and the trailing edge detection sensor S4). When the uppermost sheet fed from the document tray 102 comes in contact with the stopped conveyance roller pair 106 and the sheet detection sensor S1 disposed immediately before the conveyance roller pair 106 detects the sheet, the control unit 301 once stops the sheet feeding operation. The stopped document is conveyed to the following conveyance roller pair 107. In this case, since the feeding roller 104 is driven later than the conveyance roller pair 106, the document runs out of slack. The document holding force by the conveyance roller pair 106 is larger than the document holding force by the feeding roller 104. From the timing at which sheet conveyance is restarted, the control unit 301 starts counting driving pulses of the drive motor of the conveyance roller pair 106. When the document is conveyed up to the sheet width detection sensor S5, the control unit 301 determines the sheet size from the sheet width, as mentioned above. At this timing, however, the control unit 301 recognizes only the sheet width and therefore cannot determine the sheet size.

Then, the control unit 301 stops counting driving pulses at the timing at which the trailing edge detection sensor S4 detects the trailing edge of the sheet. Details of trailing edge detection will be described below. The control unit 301 can calculate how much the leading edge once positioned at the conveyance roller pair 106 has moved based on the counter value. The control unit 301 calculates the total amount of sheet movement based on the product of the amount of sheet movement for each driving pulse and the counter value. Since the distance (length) between the conveyance roller pair 106 and the trailing edge detection sensor S4 is predetermined, the sheet length can be accurately measured based on the sum of the amount of movement of the leading edge of the sheet once positioned at the conveyance roller pair 106 and the distance between the conveyance roller pair 106 and the trailing edge detection sensor S4. The sheet size is determined from the sheet length calculated in this way and the sheet width obtained by the sheet width detection sensor S5.

Figure 6:
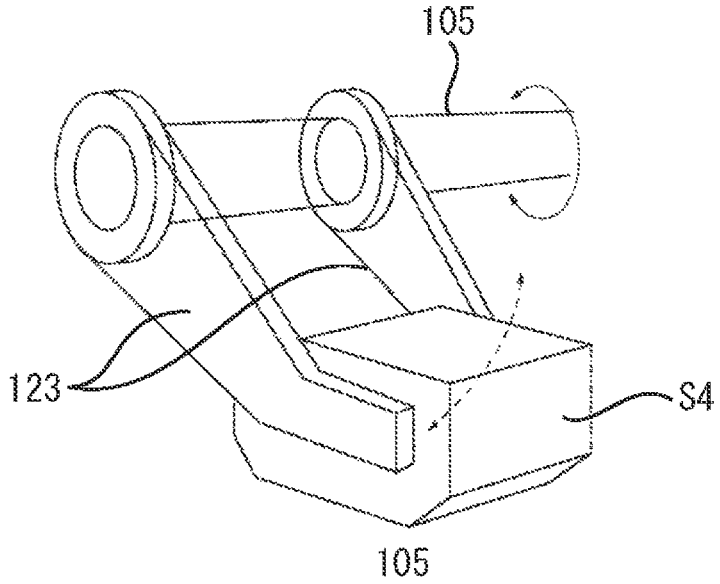
FIG. 6 is an external view of a trailing edge detection sensor.

FIG. 6 is an enlarged view of the trailing edge detection sensor S4. The trailing edge detection sensor S4 is supported by supporting members 123 which are fixed to a roller 105. When the driving force of the motor M4 forwardly or reversely rotates the roller 105, the trailing edge detection sensor S4 accordingly comes in contact with the uppermost sheet on the document tray 102. The center of the trailing edge detection sensor S4 and the center of the sheet detection sensor S1 are disposed at the same position in the width direction perpendicularly intersecting the sheet conveyance direction.

Figure 7:
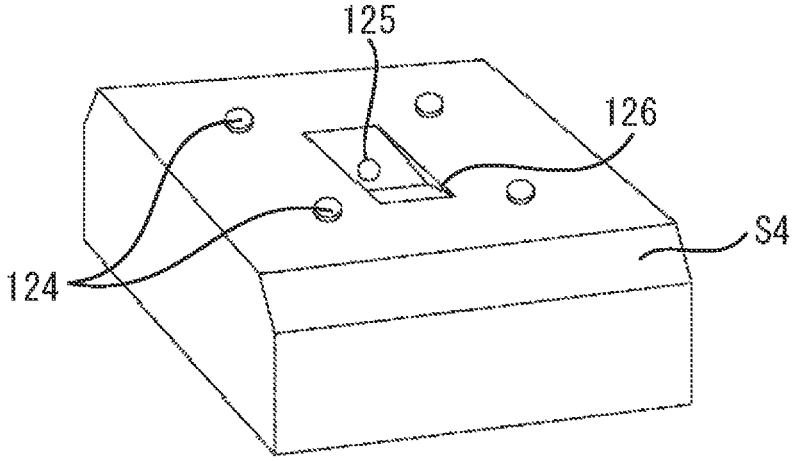
FIG. 7 illustrates the bottom face of the trailing edge detection sensor.

FIG. 7 illustrates the bottom face of the trailing edge detection sensor S4 of FIG. 6. Document stop members 124 come in contact with the uppermost sheet on the document tray 102. The document stop members 124 are coated with Teflon having a low friction coefficient so as not to damage the surface of the sheet while the sheet is moving. The trailing edge detection sensor S4 has a triangular-shaped concave portion at the center thereof. One slope of the concave portion is provided with a laser output element 125 as means for laser beam radiation, and the other slope is provided with a sensor input element 126 for accepting the laser beam radiated from the laser output element 125 and then reflected by the sheet.

Figure 8:
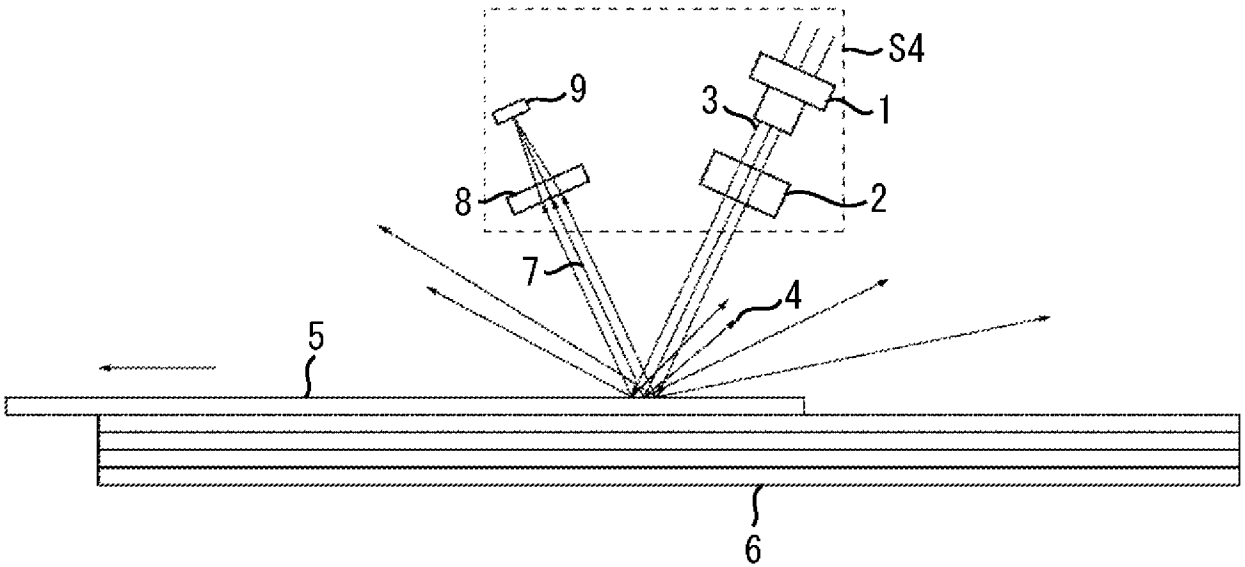
FIG. 8 illustrates a relation between the trailing edge detection sensor and a sheet.

FIG. 8 illustrates the principle of trailing edge detection by the trailing edge detection sensor S4. A laser beam 3 radiated from laser 1 irradiates an uppermost sheet 5 on the document tray 102 through a collimator lens 2. The laser 1 and the collimator lens 2 form the laser output element 125 of FIG. 7. When the laser beam 3 is reflected by fine irregularities on the surface of the sheet 5, a diffusion light (random reflection) 4 and a reflected light (specular reflection) 7 are produced. The reflected light 7 that has passed through a collective lens 8 is sensed by a 2-dimensional area sensor (image sensor) 9, such as a CCD or CMOS sensor, subjected to photoelectric conversion, and then output as an image signal. The collective lens 8 and the area sensor 9 form the sensor input element 126 of FIG. 7.

Figure 9:
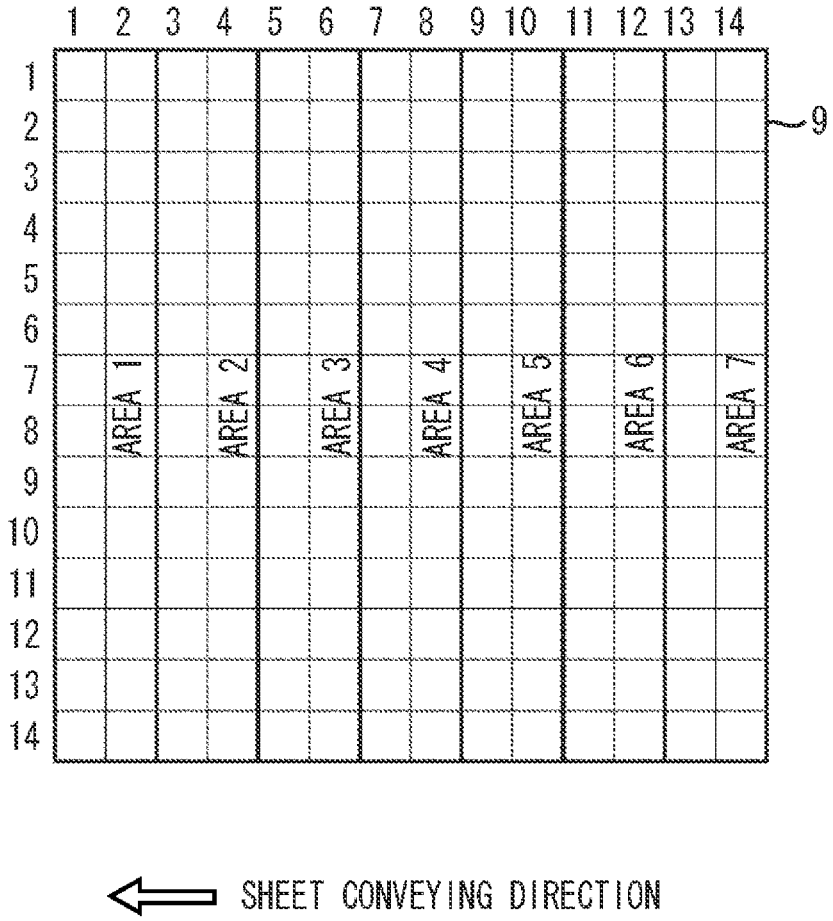
FIG. 9 illustrates detection areas of an area sensor.

The image sensed by the area sensor 9 is split into areas 1 to 7 each including two columns in the document movement direction, as shown in FIG. 9. Each area may include one column.

Figure 10:
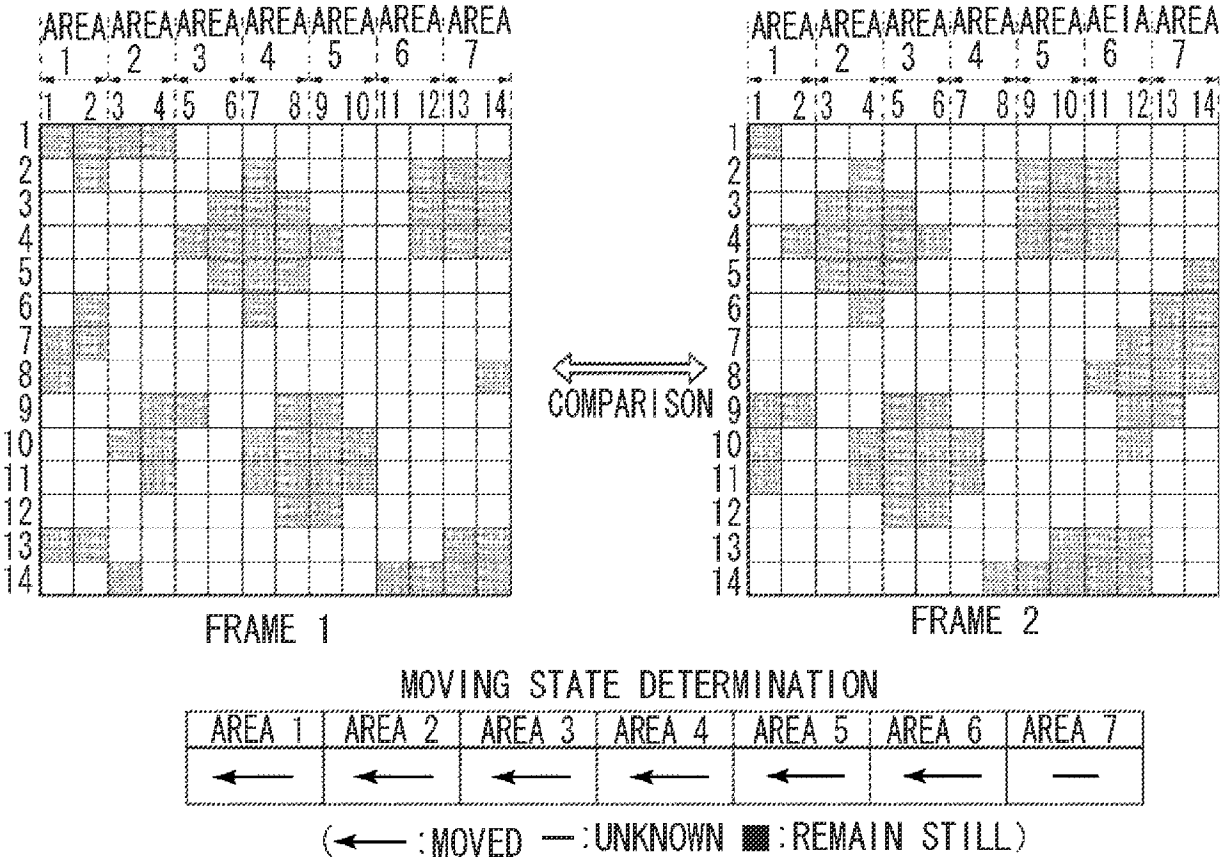
FIG. 10 illustrates a relation between an image sensed by the area sensor and the movement of a sheet.

An image output from the area sensor 9 appears as a pattern as shown in FIG. 10. This pattern, generally referred to as laser speckle, is generated by the interference of dispersion light by irregularities on the surface of document irradiated by the laser beam 3. Generally, since irregularities on the surface of sheet are not uniform but different from position to position, laser speckle differs according the position irradiated by laser. Therefore, when the document 5 being moved by the feeding roller 104 is irradiated by the laser beam 3, the pattern of an image output from the area sensor 9 changes accordingly.

FIG. 10 illustrates interference patterns taken from the document surface detected by the area sensor 9 of the trailing edge detection sensor S4. A frame 1 on the left-hand side is an image sensed by the area sensor 9 by irradiating the moving document surface with laser 3, and a frame 2 on the right-hand side is an image sensed at a predetermined timing after sensing the frame 1. The control unit 301 determines whether or not the document is moving by comparing the image of the frame 1 with the image of the frame 2.

When the control unit 301 compares the image of the frame 1 with the image of the frame 2, the control unit 301 recognizes that the pattern ranging from the areas 3 to 7 of the frame 1 has moved to the areas 1 to 6 of the frame 2. More specifically, the control unit 301 recognizes that a pattern having a center at column 7/row 4 in the area 4 of the frame 1 has moved to a pattern having a center at column 4/row 4 in the area 2 of the frame 2. Further, a new pattern which does not exist in the frame 1 appears in the area 7 of the frame 2. Therefore, the control unit 301 determines it impossible to decide whether or not the pattern in the area 7 of the frame 2 has moved. In this way, the control unit 301 irradiates the document with a reflected light (interference pattern) of the laser beam to detect the movement of a pattern in images sensed at predetermined time intervals, thus recognizing the moving state of the sheet. That is, the control unit 301 compares a pattern in each area of the frame 1 with a pattern in each area of the frame 2 subsequently sensed and then determines whether or not the pattern in each area has moved.

Figure 11:
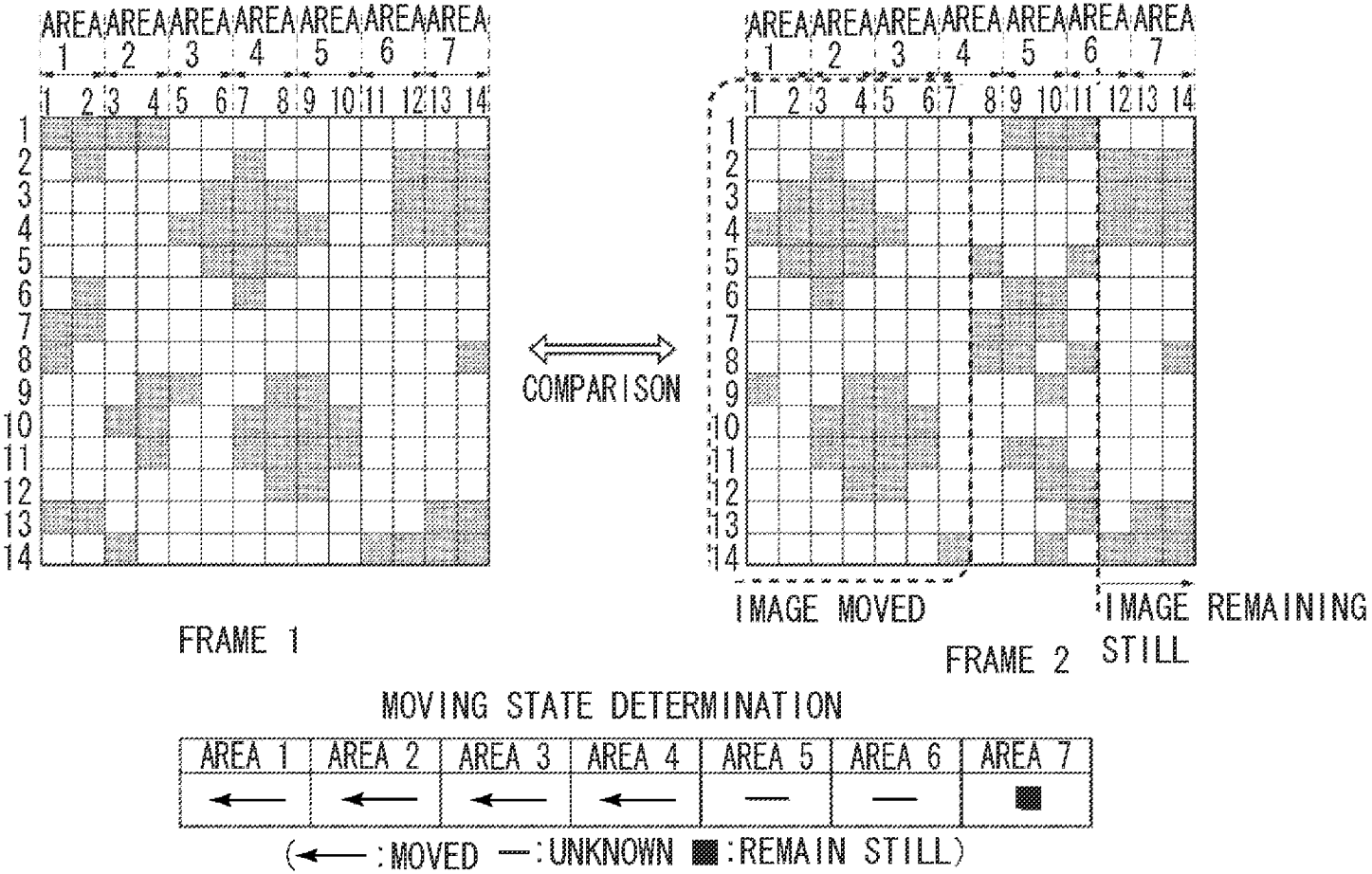
FIG. 11 illustrates a relation between an image sensed by the area sensor and the movement of a sheet.

Similarly to FIG. 10, FIG. 11 illustrates interference patterns from the document surface detected by the area sensor 9 of the trailing edge detection sensor S4. A method for detecting the trailing edge of the sheet will be described below with reference to FIG. 11. When the control unit 301 compares the image of the frame 1 with the image of the frame 2, the pattern ranging from the area 3 to the first column of the area 6 (columns 5 to 11) of the frame 1 has moved to the area 1 to the first column of the area 4 (columns 1 to 7) of the frame 2. However, the pattern ranging from the second column of the area 6 to the area 7 of the frame 1 remains still in the frame 2. The pattern ranging from the second column of the area 4 to the first column of the area 6 of the frame 2 is a new pattern which does not exist in the frame 1. In this case, although the control unit 301 determines that the pattern ranging from the areas 1 to 4 of the frame 2 has moved, the control unit 301 performs a process regarding the moving state of the new pattern ranging from the areas 5 to 6 of the frame 2 as unknown. On the other hand, since the pattern ranging from the second column of the area 6 to the area 7 of the frame 2 is the same as the pattern ranging from the second column of the area 6 to the area 7 of the frame 1, the control unit 301 determines that the pattern ranging from the second column of the area 6 to the area 7 of the frame 2 remains still. This means that the image of the frame 2 contains an area where a pattern remains still. Therefore, the control unit 301 determines that the pattern ranging from columns 12 to 14 of the frame 2 is a part of a document under the uppermost sheet on the document tray 102, and that the pattern ranging from column 8 to 11 of the frame 2 is a part of a document immediately under the uppermost sheet on the document tray 102, which appears when the uppermost sheet moves. As a result, the control unit 301 determines that the boundary between the columns 7 and 8 of the frame 2 is the trailing edge of the sheet.

In this way, when the image of the frame 2 contains an area where a pattern remains still, the control unit 301 determines that the boundary between a moved pattern and a new pattern is the trailing edge of the sheet. Depending on the sensing timing of the frame 2, a new pattern does not appear. In this case, the control unit 301 may determine that the boundary between a moved pattern and a pattern remaining still is the trailing edge of the sheet.

Figure 12:
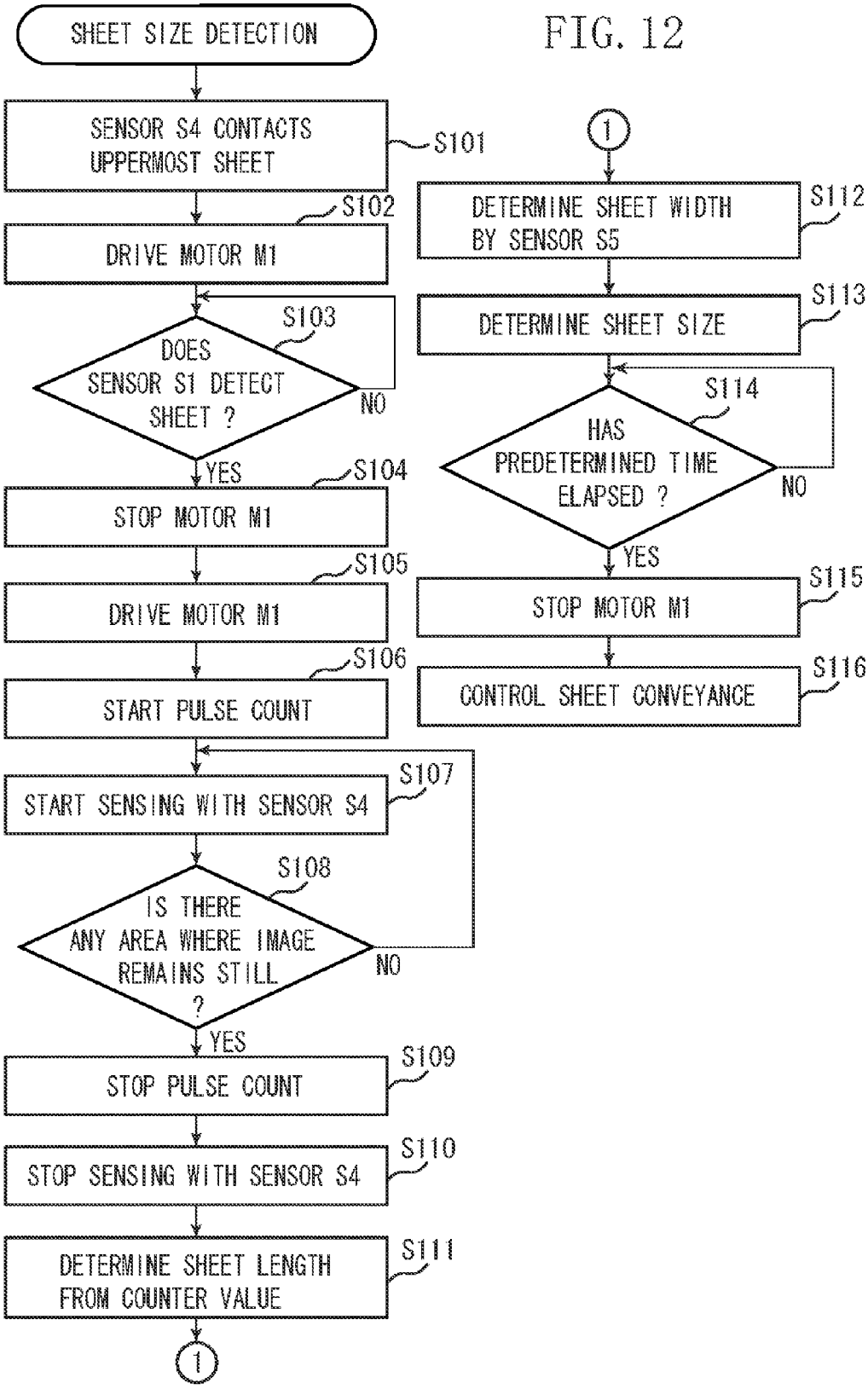
FIG. 12 is a flow chart of sheet size detection processing.

Document size detection processing performed by the control unit 301 of FIG. 3 will be described below with reference to the flow chart of FIG. 12.

In step S101, upon reception of a document feeding start instruction, the control unit 301 drives the motor M4 to allow the trailing edge detection sensor S4 to come in contact with the uppermost sheet on the document tray 102. In step S102, the control unit 301 drives the motor M1 to drive the feeding roller 104. In step S103, the control unit 301 determines whether or not the sheet detection sensor S1 detects the sheet. In step S104, when the sheet detection sensor S1 detects the sheet (YES in step 103), the control unit 301 stops driving the motor M1 after a predetermined time has elapsed. In step S105, the control unit 301 starts driving the motor M1 to restart sheet conveyance. In step S106, the control unit 301 starts counting driving pulses of the motor M1 generated in synchronization with sheet conveyance. In step S107, the control unit 301 starts sensing by the area sensor 9 of the trailing edge detection sensor S4. In step S107, the control unit 301 periodically performs sensing and then compares images of two frames obtained in two successive sensing operations. As mentioned above, in step S108, the control unit 301 determines whether or not the image of the frame 2 contains an area where a pattern remains still, that is, whether or not the trailing edge of the sheet is detected. When the control unit 301 does not detect the trailing edge of the sheet (NO in step S108), it repeats sensing by the area sensor 9 and image analysis until the trailing edge of the sheet is detected. When the control unit 301 detects the trailing edge of the sheet (YES in step S108), it stops counting driving pulses of the motor M1 in step S109, and stops sensing by the area sensor 9 in step S110.

The number of driving pulses of the motor M1 is directly proportional to the rotational angle of the motor M1. In other words, counting the number of driving pulses of the motor M1 makes it possible to obtain the total rotational angle of the motor M1, i.e., the number of rotations of the conveyance roller pair 106 connected to the driving shaft of the motor M1, thus obtaining the amount of sheet movement. In step S111, the control unit 301 calculates the amount of sheet movement from the count value to determine the sheet length. The control unit 301 determines the sheet length as mentioned above. Further, in step S112, the control unit 301 detects the sheet width by using the sheet width detection sensor S5 based on the above-mentioned method. The control unit 301 can detect the sheet width at any timing after restarting sheet conveyance in step S105 and the leading edge of the sheet has reached the sheet width detection sensor S5. In step S113, the control unit 301 determines the sheet size based on the sheet width and the sheet length. When a predetermined time has elapsed after the trailing edge of the sheet is detected, the control unit 301 stops driving the motor M1 in step S115, and continuously performs sheet conveyance control in step S116 to read subsequent document images. The control unit 301 repeats the processing from step S102 for the following document.

As mentioned above, the method according to the present invention detects the trailing edge of the sheet at an earlier timing, and therefore determines the sheet size at an earlier timing, than the conventional configuration.

The above-mentioned method for detecting the trailing edge is applicable not only to detection of the trailing edge of the originals but also to detection of the trailing edge of recording sheets on the sheet feeding unit of image forming apparatuses such as copying machines. For example, the above-mentioned technique is applicable to size detection of a sheet loaded on a manual feed tray of image forming apparatuses.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-237892 filed Sep. 17, 2008, which is hereby incorporated by reference herein in its entirety.

What is claimed is:

1. A sheet feeding apparatus comprising:

a sheet loading unit configured to load a plurality of sheets;

a sheet feeding unit configured to feed the sheets loaded on the sheet loading unit;

a light emitting unit configured to irradiate a sheet loaded on the sheet loading unit;

an image sensor disposed at a position opposing the sheet loaded on the sheet loading unit and configured to sense an image reflected with light irradiated by the light emitting unit; and a trailing edge detection unit configured to cause the image sensor to repetitively perform sensing during sheet conveyance by the sheet feeding unit, compare images sensed by splitting an sensing range of the image sensor in a sheet conveyance direction, and detect a trailing edge of the sheet currently being conveyed from the sheet feeding unit based on a determination of an area where a pattern remains unchanged in the compared images by determining whether each pattern of the compared images is same in a first area of the plurality of areas and each pattern of the compared images is not same in a second area of the plurality of areas.

2. The sheet feeding apparatus according to claim 1, wherein the image sensor senses interference patterns generate when the sheet is irradiated by the light emitting unit.

3. The sheet feeding apparatus according to claim 1, further comprising:

a sheet conveyance unit configured to convey a sheet fed by the sheet feeding unit;

a pulse generation unit configured to generate pulses in synchronization with sheet conveyance by the sheet conveyance unit;

a counter configured to count a number of driving pulses generated by the pulse generation unit during a time period since the sheet conveyance unit starts sheet conveyance until the trailing edge detection unit detects the trailing edge; and a sheet length determination unit configured to determine length of the sheet in the sheet conveyance direction based on the number of driving pulses counted by the counter.

4. The sheet feeding apparatus according to claim 1, further comprising:

a sheet conveyance unit configured to convey a sheet fed by the sheet feeding unit;

a measurement unit configured to measure a time period since the sheet conveyance unit starts sheet conveyance until the trailing edge detection unit detects the trailing edge; and a sheet length determination unit configured to determine a length of the sheet in the sheet conveyance direction based on the time period measured by the measurement unit and a speed of sheet conveyed by the sheet conveyance unit.

5. The sheet feeding apparatus according to claim 3, further comprising:

a sheet width detection unit configured to detect a sheet width in a width direction perpendicularly intersecting the sheet conveyance direction; and a sheet size detection unit configured to detect a size of the sheet based on the sheet length determined by the sheet length determination unit and the sheet width detected by the sheet width detection unit.

6. The sheet feeding apparatus according to claim 4, further comprising:

a sheet width detection unit configured to detect a sheet width in a width direction perpendicularly intersecting the sheet conveyance direction; and a sheet size detection unit configured to detect a size of the sheet based on the sheet length determined by the sheet length determination unit and the sheet width detected by the sheet width detection unit.

7. The sheet feeding apparatus according to claim 1, wherein the image sensor is disposed at a position on a upstream side of the sheet feeding unit in a feeding direction of the sheet feeding unit.

8. The sheet feeding apparatus according to claim 5, further comprising:

an image reading unit configured to read an image of the sheet conveyed by the sheet conveyance unit; and a magnification changing unit configured to change the magnification of the image read by the image reading unit based on the sheet size detected by the sheet size detection unit.

9. The sheet feeding apparatus according to claim 6, further comprising:

an image reading unit configured to read an image of the sheet conveyed by the sheet conveyance unit; and a magnification changing unit configured to change the magnification of the image read by the image reading unit based on the sheet size detected by the sheet size detection unit.

10. A sheet feeding apparatus comprising:

a sheet stack tray configured to stack a plurality of sheets to be fed;

a sheet feeding unit configured to feed an uppermost sheet stacked on the sheet stack tray;

a light emitting unit configured to irradiate a position at which sheets overlap each other on the sheet stack tray;

a two-dimensional image sensor disposed at a position opposing the sheets stacked on the sheet stack tray and configured to sense an interference pattern caused by reflection of light irradiated by the light emitting unit;

a determination unit configured to compare a first image sensed by the two-dimensional image sensor at first timing during sheet conveyance by the sheet feeding unit and a second image sensed by the two-dimensional image sensor at second timing during the sheet conveyance by the sheet feeding unit, and to determine a first area including a pattern that exists in both the first image and the second image and that has positionally moved and a second area including a pattern that exists in both the first image and the second image and that has not positionally moved; and a trailing edge detection unit configured to detect a trailing edge of the first area as a trailing edge of a sheet being conveyed in a case where it is determined by the determination unit that the first area and the second area exist in the second image.

11. The sheet feeding apparatus according to claim 10, further comprising:

a sheet conveyance unit configured to convey a sheet fed by the sheet feeding unit;

a pulse generation unit configured to generate pulses in synchronization with sheet conveyance by the sheet conveyance unit;

a counter configured to count a number of driving pulses generated by the pulse generation unit during a time period since the sheet conveyance unit starts sheet conveyance until the trailing edge detection unit detects the trailing edge; and a sheet length determination unit configured to determine length of the sheet in the sheet conveyance direction based on the number of driving pulses counted by the counter.

12. The sheet feeding apparatus according to claim 10, further comprising:

a sheet conveyance unit configured to convey a sheet fed by the sheet feeding unit;

a measurement unit configured to measure a time period since the sheet conveyance unit starts sheet conveyance until the trailing edge detection unit detects the trailing edge; and a sheet length determination unit configured to determine a length of the sheet in the sheet conveyance direction based on the time period measured by the measurement unit and a speed of sheet conveyed by the sheet conveyance unit.

13. The sheet feeding apparatus according to claim 11, further comprising:

a sheet width detection unit configured to detect a sheet width in a width direction perpendicularly intersecting the sheet conveyance direction; and a sheet size detection unit configured to detect a size of the sheet based on the sheet length determined by the sheet length determination unit and the sheet width detected by the sheet width detection unit.

14. The sheet feeding apparatus according to claim 12, further comprising:

a sheet width detection unit configured to detect a sheet width in a width direction perpendicularly intersecting the sheet conveyance direction; and a sheet size detection unit configured to detect a size of the sheet based on the sheet length determined by the sheet length determination unit and the sheet width detected by the sheet width detection unit.

15. The sheet feeding apparatus according to claim 10, wherein the image sensor is disposed at a position on a upstream side of the sheet feeding unit in a feeding direction of the sheet feeding unit.

16. The sheet feeding apparatus according to claim 13, further comprising:

an image reading unit configured to read an image of the sheet conveyed by the sheet conveyance unit; and a magnification changing unit configured to change the magnification of the image read by the image reading unit based on the sheet size detected by the sheet size detection unit.

17. The sheet feeding apparatus according to claim 14, further comprising:

an image reading unit configured to read an image of the sheet conveyed by the sheet conveyance unit; and a magnification changing unit configured to change the magnification of the image read by the image reading unit based on the sheet size detected by the sheet size detection unit.

* * * * *